US010126706B2

(12) United States Patent
Shuhama et al.

(10) Patent No.: US 10,126,706 B2
(45) Date of Patent: Nov. 13, 2018

(54) IMAGE-FORMING APPARATUS AND CARTRIDGE

(71) Applicant: CANON KABUSHIKI KAISHA, Tokyo (JP)

(72) Inventors: Yu Shuhama, Yokohama (JP); Yoichiro Iizuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/633,602

(22) Filed: Jun. 26, 2017

(65) Prior Publication Data

US 2018/0004153 A1 Jan. 4, 2018

(30) Foreign Application Priority Data

Jun. 29, 2016 (JP) ..... 2016-129040

(51) Int. Cl.

*G03G 15/08* (2006.01)
*G03G 21/18* (2006.01)
*G03G 21/16* (2006.01)

(52) U.S. Cl.

CPC ..... *G03G 21/186* (2013.01); *G03G 15/0839* (2013.01); *G03G 21/1647* (2013.01); *G03G 21/1814* (2013.01); *G03G 21/1864* (2013.01)

(58) Field of Classification Search

CPC ..... G03G 15/0839
USPC ..... 399/263
See application file for complete search history.

(56) References Cited

U.S. PATENT DOCUMENTS

| | | | | |
|---|---|---|---|---|
| 5,903,803 | A | 5/1999 | Kawai | |
| 7,747,191 | B2 | 6/2010 | Kawasumi | |
| 9,684,261 | B2 * | 6/2017 | Miyabe | G03G 15/0896 |
| 2007/0280727 | A1 * | 12/2007 | Kawasumi | G03G 15/757 399/111 |
| 2008/0138115 | A1 | 6/2008 | Chadani et al. | |
| 2014/0270851 | A1 * | 9/2014 | Matsuda | F16H 1/10 399/167 |
| 2014/0294445 | A1 | 10/2014 | Veno Daijiro | |
| 2017/0357210 | A1 * | 12/2017 | Inaba | G03G 21/1857 |

FOREIGN PATENT DOCUMENTS

| | | | |
|---|---|---|---|
| JP | 8-6368 | A | 1/1996 |
| JP | 8-44247 | A | 2/1996 |
| JP | 8-328449 | A | 12/1996 |
| JP | 2006-171631 | A | 6/2006 |
| JP | 2013-127596 | A | 6/2013 |
| JP | 2013231996 | A | 11/2013 |
| JP | 2014-160223 | A | 9/2014 |
| JP | 5657064 | B2 | 1/2015 |
| RU | 2539761 | C2 | 1/2015 |

* cited by examiner

*Primary Examiner* — Walter L Lindsay, Jr.
*Assistant Examiner* — Arlene Heredia Ocasio
(74) *Attorney, Agent, or Firm* — Canon USA, Inc., IP Division

(57) ABSTRACT

An image-forming apparatus includes a coupling recess to be engaged with a coupling protrusion to rotate the coupling protrusion, a second gear portion to be engaged with a gear to rotate the gear, and a driving force transmitter that is rotatable about a predetermined rotational axis. A torque required to rotate the gear is larger than a torque required to rotate the second gear portion in a state where the coupling recess does not engage the coupling protrusion.

18 Claims, 13 Drawing Sheets

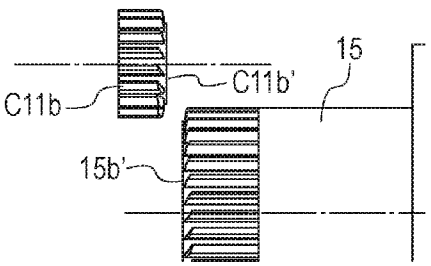
FIG. 13C
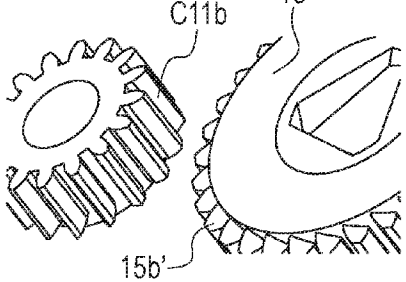
FIG. 13B
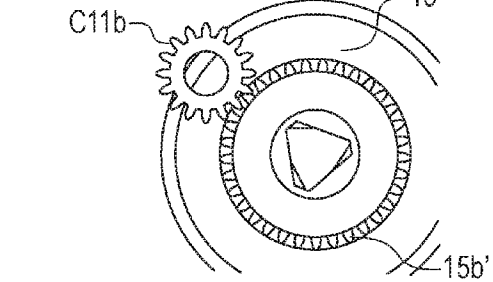
FIG. 13A
FIG. 13F
FIG. 13E
FIG. 13D
FIG. 13I
FIG. 13H
FIG. 13G

IMAGE-FORMING APPARATUS AND CARTRIDGE

BACKGROUND OF THE INVENTION

Field of the Invention

The present invention relates to an electrophotographic image-forming apparatus that forms an image on a recording material in an electrophotographic manner with a cartridge installed, and the cartridge.

Description of the Related Art

In an electrophotographic image-forming apparatus (also referred to below as simply an "image-forming apparatus"), an electrophotographic photosensitive member that serves as an image-bearing member and is typically a drum type, that is, a photosensitive drum is uniformly charged. Subsequently, the charged photosensitive drum is selectively exposed to light to form an electrostatic latent image (electrostatic image) on the photosensitive drum. Subsequently, the electrostatic latent image formed on the photosensitive drum is developed to be a toner image with a toner serving as a developer. The toner image formed on the photosensitive drum is transferred to a recording material such as a recording sheet or a plastic sheet. The toner image transferred to the recording material is heated and pressed to fix the toner image to the recording material, so that an image is recorded.

Such an image-forming apparatus typically needs supply of the toner and maintenance of various process devices. The photosensitive drum, a charging device, a developing device, a cleaning device, for example, are integrated inside a housing into a cartridge to facilitate the supply of the toner and the maintenance. Such a cartridge, which is attachable to and detachable from a main body of the image-forming apparatus, has been put into practical use.

Japanese Patent Laid-Open No. 8-328449 discloses an image-forming apparatus including a driving force transmitter that includes at an end thereof a coupling for transmitting a driving force from the main body of the image-forming apparatus to a cartridge and that is urged by a spring toward a cartridge side. In the image-forming apparatus, when a door of the main body of the image-forming apparatus is closed, the driving force transmitter is pressed by the spring, moves toward the cartridge side, and engages a coupling of the cartridge to transmit a driving force. When the door of the main body of the image-forming apparatus is opened, a cam moves the driving force transmitter against the spring in the direction in which the driving force transmitter leaves the cartridge. Thus, the driving force transmitter is attachable and detachable.

There is no driving source in a process cartridge, and a driving force needs to be transmitted from the main body of the image-forming apparatus. Accordingly, there is a need to provide a driving-force-transmitting unit. When the process cartridge is attached or detached, in some cases, the process cartridge comes into contact with a driving-force-transmitting portion, and the photosensitive drum, a charge roller, or a developing roller, for example, is rotated. This leaves a scratch and causes a defective image.

As disclosed in Japanese Patent Laid-Open No. 8-328449, prismatic couplings for the photosensitive drum of the process cartridge and the driving-force-transmitting portion of the image-forming apparatus are used as driving-force-transmitting units to prevent the above problems. In a known method for transmitting a driving force, through an opening or closing operation of the door when the process cartridge is taken in or out, the coupling on the main body side is retracted from a trajectory along which the process cartridge is inserted, and, when the door is closed, the retracted coupling on the main body side is joined to the coupling on the process cartridge side.

The cartridge described herein includes driven bodies such as the photosensitive drum and the developing roller and engaged portions for transmitting a driving force to the driven bodies and drives the driven bodies with engaging portions of the main body of the apparatus engaging the respective engaged portions of the cartridge. With such a structure, in some cases where some of the engaging portions engage some of the engaging portions earlier than the others, only some of the driven bodies rotate during the engagement operation. When some of the driven bodies rotate, for example, there is a possibility that a toner leaks to the photosensitive drum or the other portions, some of the driven bodies come into sliding contact with the other driven bodies and damage, and these cause, for example, a defective image.

SUMMARY OF THE INVENTION

The present invention provides an image-forming apparatus and a cartridge that inhibit rotation of only some of the driven bodies in the case where some of the engaging portions engage some of the engaging portions earlier than the others.

The present invention provides an image-forming apparatus including a main body of the apparatus in which a cartridge including a first driven body, a second driven body, a first engaged portion to be engaged for receiving a driving force that causes the first driven body to be driven, and a second engaged portion to be engaged for receiving a driving force that causes the second driven body to be driven is installed, and a driving force transmitter that includes a first engaging portion engaging the first engaged portion to rotate the first engaged portion and a second engaging portion engaging the second engaged portion to rotate the second engaged portion and that is rotatable about a predetermined rotational axis. A torque required to rotate the second engaged portion is larger than a torque required to rotate the second engaging portion in a state where the first engaging portion does not engage the first engaged portion.

Further features of the present invention will become apparent from the following description of exemplary embodiments with reference to the attached drawings.

BRIEF DESCRIPTION OF THE DRAWINGS

FIGS. 13A to 13I illustrate the relationship between a second gear portion and the gear.

DESCRIPTION OF THE EMBODIMENTS

First Embodiment

Image-Forming Apparatus

Figure 1:
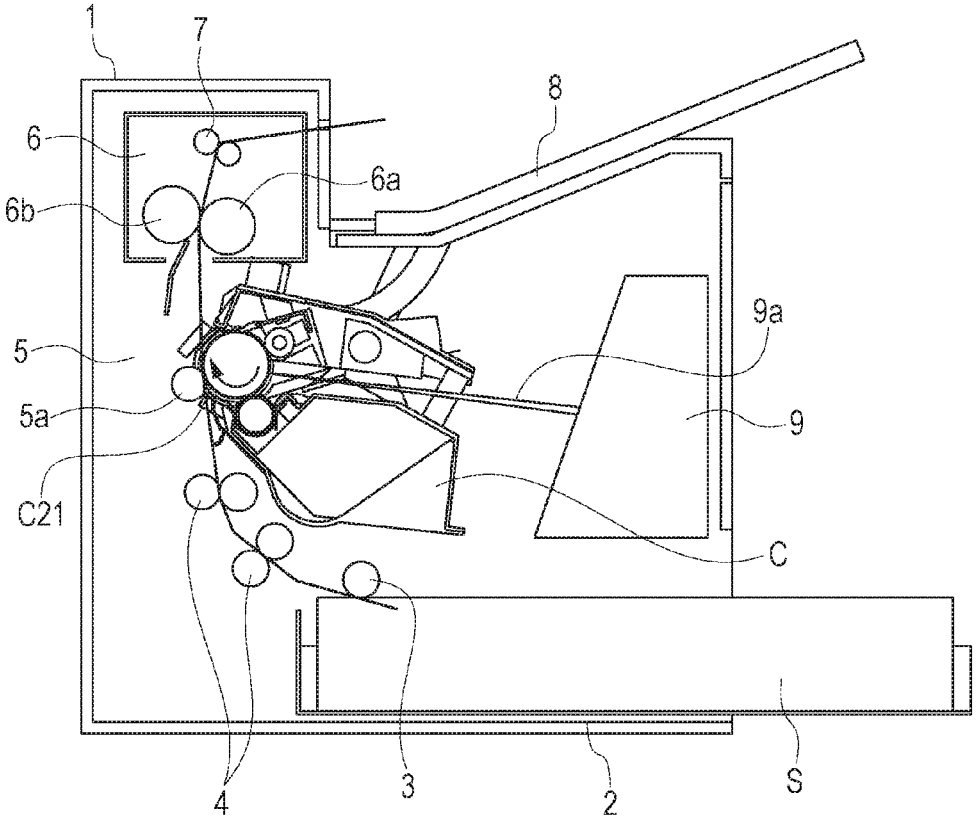
FIG. 1 is a schematic sectional view of an image-forming apparatus.

FIG. 1 is a schematic sectional view of an image-forming apparatus taken along a line perpendicular to the direction of the rotational axis of a photosensitive drum C21. An electrophotographic image-forming apparatus 1 (referred to below as a main body of the apparatus) is a laser beam printer, in which a process cartridge C (referred to below as a cartridge) is detachably installed, which forms an image in an electrophotographic manner. In the following description, the direction of the rotational axis of the photosensitive drum C21 with the cartridge C installed in the main body of the apparatus 1 is referred to as a longitudinal direction. The main body of the apparatus 1 includes an exposure device 9 (laser scanner unit) for forming a latent image on the photosensitive drum C21 serving as an image-bearing member of the cartridge C installed in the main body of the apparatus 1. A sheet feed tray 2 that contains a recording medium S (referred to below as a sheet), on which an image is to be formed, is located at a lower portion of the main body of the apparatus 1 in a space in which the cartridge C is installed. In the main body of the apparatus 1, for example, a pickup roller 3, a pair of conveyance rollers 4, a transfer portion 5, a fixing device 6, a pair of sheet-discharging rollers 7, and a sheet discharge tray 8 are arranged in this order in the direction in which the sheet S is conveyed.

Image Forming Process

Figure 2:
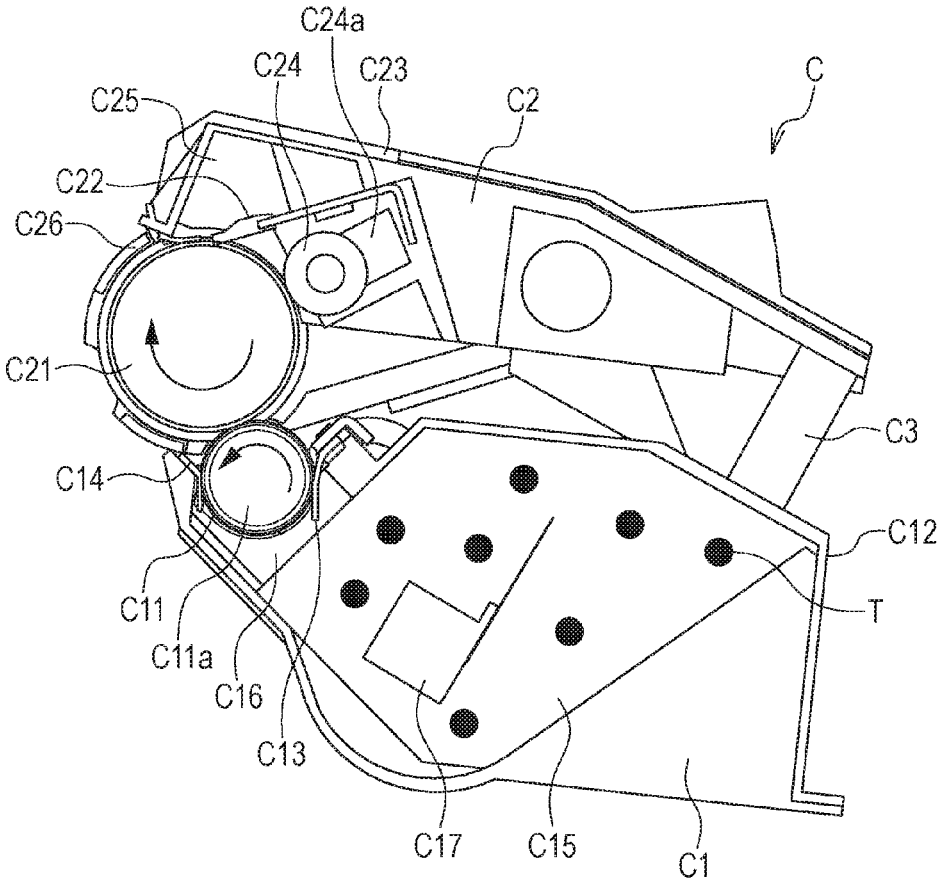
FIG. 2 is a schematic sectional view of a cartridge.

An outline of an image forming process will be described with reference to FIG. 1 and FIG. 2. FIG. 2 is a schematic sectional view of the cartridge C and illustrates only the cartridge C extracted from the schematic sectional view in FIG. 1.

The photosensitive drum C21 is rotated by a driving source of the main body of the apparatus 1 at a predetermined circumferential speed. A bias voltage is applied to a charge roller C24 that is in contact with the photosensitive drum C21 and that is rotated. The outer circumferential surface of the photosensitive drum C21 is uniformly charged. The laser scanner 9 scans a laser beam 9*a* in accordance with an image over the surface of the charged photosensitive drum C21, which is exposed to light, so that an electrostatic latent image is formed on the outer circumferential surface of the photosensitive drum C21.

Toner T in a toner chamber C15 is agitated in a developing unit C1 and conveyed to a toner supply chamber C16 by using a toner conveying member C17 operated by a driving force from the main body of the apparatus 1. The toner T is held on the surface of the developing roller C11 by using a magnetic force of a magnetic roller C11*a* inside the developing roller C11. The toner T on the developing roller C11 that is rotated by a driving force from the main body of the apparatus 1 is charged by friction by using a development blade C13, which restricts the thickness of a surface layer of the developing roller C11. The toner T on the developing roller C11 is developed on the photosensitive drum C21 on the basis of the electrostatic latent image on the rotating photosensitive drum C21 and becomes a visible image as a toner image.

The sheet S stacked on the sheet feed tray 2 is conveyed by using the pickup roller 3 and the conveyance rollers 4 in a timed relation to formation of the toner image. When the sheet S is conveyed to the transfer portion 5 between the photosensitive drum C21 and a transfer roller 5*a*, the toner image on the photosensitive drum C21 is transferred to the sheet S at the transfer portion 5. The sheet S on which the toner image is transferred is conveyed to the fixing device 6. The sheet S passes through a nip portion between a heat roller 6*a* and a pressure roller 6*b* of the fixing device 6. The toner image is fixed to the sheet S in a manner in which the sheet is heated and pressed at the nip portion. The sheet S to which the toner image is fixed is conveyed by using the sheet-discharging rollers 7 and discharged to and stacked on the sheet discharge tray 8.

Process Cartridge

Figure 3A:
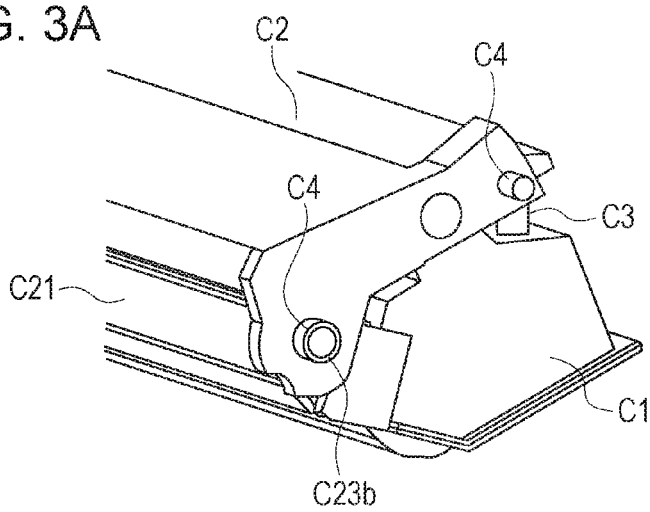
FIG. 3A is a schematic perspective view of the cartridge viewed from a drive side.
Figure 3B:
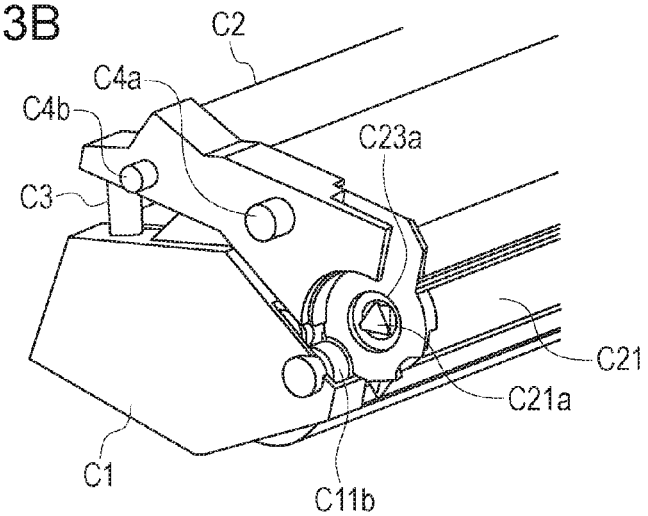
FIG. 3B is a schematic perspective view of the cartridge viewed from a non-drive side.
Figure 3C:
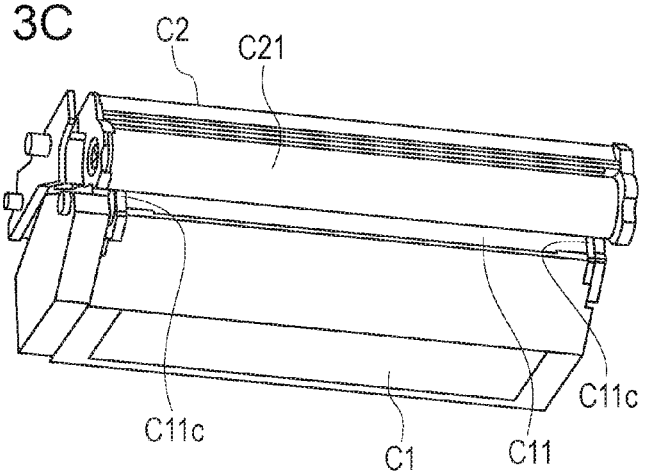
FIG. 3C is a schematic perspective view of the cartridge viewed from a photosensitive drum side.

The structure of the cartridge C will be described with reference to FIG. 2, and FIGS. 3A, 3B, and 3C. FIG. 3A is a schematic perspective view of the cartridge C viewed from a drive side. FIG. 3B is a schematic perspective view of the cartridge C viewed from a non-drive side. FIG. 3C is a schematic perspective view of the cartridge C viewed from a photosensitive drum side.

The cartridge C can be divided mainly into a cleaning unit C2 and the developing unit C1. A typical process cartridge is a unit that is attachable to and detachable from the main body of the apparatus 1 and that is integrally formed of an electrophotographic photosensitive member and at least one of a charging device, a developing device, and a cleaning device, which are process devices that act on the electrophotographic photosensitive member.

The cleaning unit C2 includes the photosensitive drum C21 (first driven body), the charge roller C24, a cleaning member C22, and a cleaning housing C23 that supports these. As illustrated in FIGS. 3A and 3B, the photosensitive drum C21 includes a coupling protrusion C21*a* (first engaged portion) that transmits a driving force from the main body of the image-forming apparatus to the drive side. The photosensitive drum C21 is rotatably supported by bearings C23*a* and C23*b* disposed on the drive side and the non-drive side of the cleaning housing C23.

In the cleaning unit C2, the charge roller C24 and the cleaning member C22 are located so as to be in contact with the outer circumferential surface of the photosensitive drum C21. The cleaning member C22 is a rubber blade, which is an elastic blade member formed of an elastic rubber material.

The rubber blade is in contact with the photosensitive drum C21 such that an end portion thereof faces the upper stream side in the direction in which the photosensitive drum C21 rotates. Waste toner removed from the surface of the photosensitive drum C21 by using the cleaning member C22 is stored in a waste toner chamber C25 formed of the cleaning housing C23 and the cleaning member C22. A scoop sheet C26 for preventing the waste toner T from leaking from the cleaning housing C23 is disposed on an edge portion of the cleaning housing C23 so as to be in contact with the photosensitive drum C21.

The charge roller C24 is attached to both end portions of the cleaning housing C23 in the longitudinal direction in the cleaning unit C2 so as to be rotatable by using a charge roller bearing C24*a*. The charge roller C24 is in pressure contact with the photosensitive drum C21 in a manner in which the charge roller bearing C24*a* is pressed toward the photosensitive drum C21 by using an urging member, not illustrated. The charge roller C24 is rotated along with rotation of the photosensitive drum C21.

The developing unit C1 includes the developing roller C11 (second driven body), a developer container C12 that supports the developing roller, and the development blade C13. The developing roller C11 is rotatably attached to the developer container C12 by using bearing members disposed at both ends. As illustrated in FIG. 3B, a gear C11*b* (second engaged portion) for transmitting a driving force from the main body of the image-forming apparatus 1 is at the end portion of the developing roller C11 on the drive side. The magnetic roller C11*a* is disposed inside the developing roller C11.

In the developing unit C1, the development blade C13 for restricting a toner layer on the developing roller C11 is disposed. As illustrated in FIG. 3C, spacing members C11*c* are attached to both end portions of the developing roller C11 in the direction of the rotational axis. The spacing members C11*c* and the photosensitive drum C21 are in contact with each other, and the developing roller C11 is thus held with the position thereof set such that there is a small space between the developing roller C11 and the photosensitive drum C21.

During the formation of the image, the developing roller C11 is driven by using a drive train that uses the gear C11*b* (FIG. 3B), which is different from a drive train for the photosensitive drum C21 driven by using the coupling protrusion C21*a*.

A leakage prevention sheet C14 for preventing the toner T from leaking from the developing unit C1 is disposed at an edge portion of a bottom member so as to be in contact with the developing roller C11. The toner conveying member C17 is disposed in the toner chamber C15 of the developer container C12. The toner conveying member C17 agitates the toner T contained in the toner chamber C15 and conveys the toner T to the toner supply chamber C16.

The cleaning unit C2 and the developing unit C1 are rotatably connected to each other and urged by an elastic member C3 (spring). The developing unit C1 and the cleaning unit C2 are pressed against each other by an urging force of the spring C3, so that the spacing members C11*c* of the developing roller C11 are pressed against the photosensitive drum C21 with certainty. The developing roller C11 is held by the spacing members C11*c* attached to both end portions of the developing roller C11 at a predetermined interval from the photosensitive drum C21, as described above.

Structure for Attachment and Detachment of Cartridge

Figure 4:
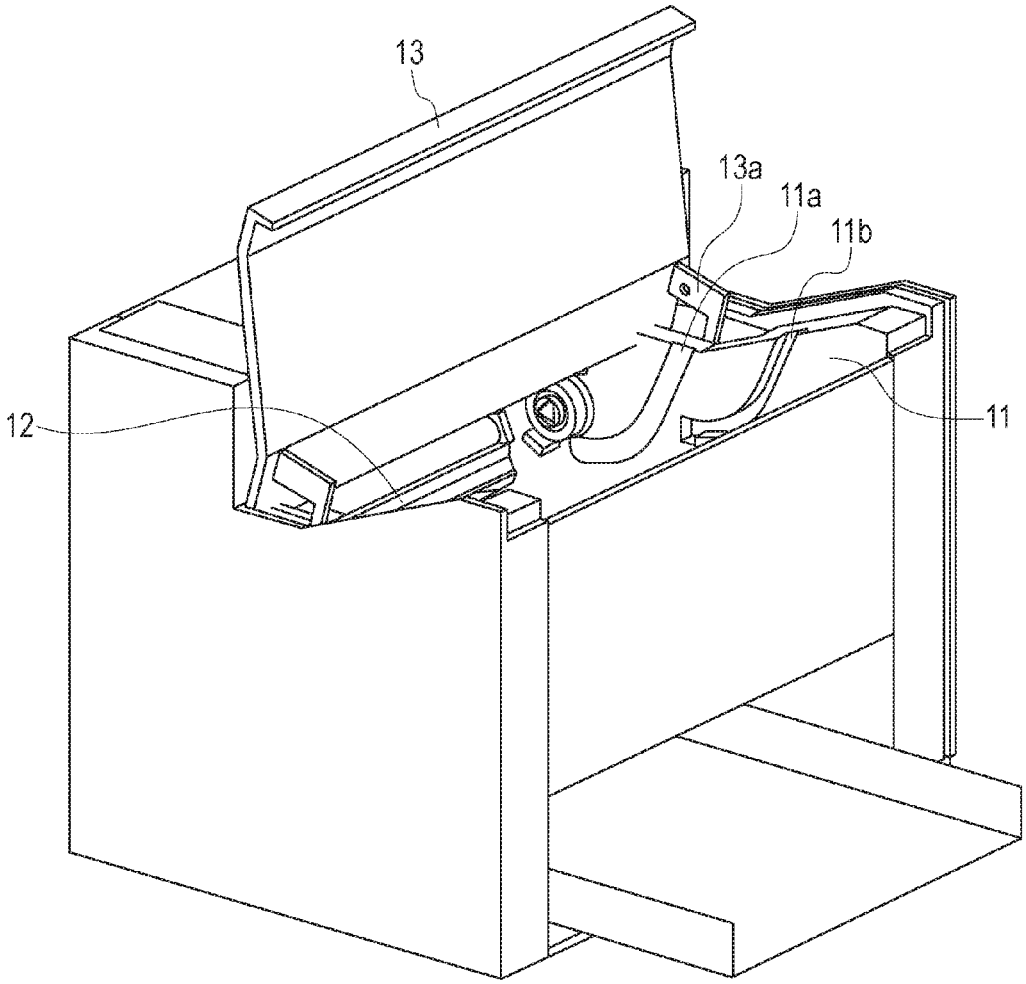
FIG. 4 is a schematic perspective view of the image-forming apparatus.
Figure 5A:
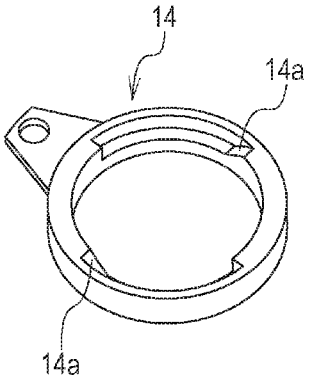
FIG. 5A is a perspective view of a cylinder cam.
Figure 5B:
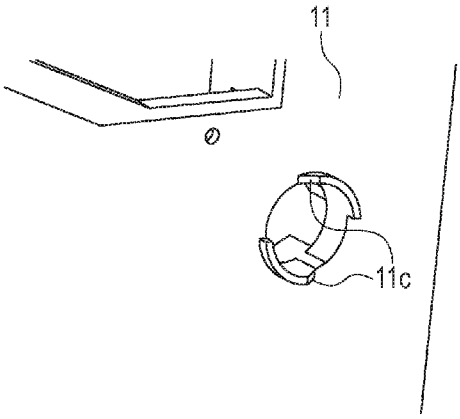
FIG. 5B is a perspective view of a drive-side side plate near a location to which the cylinder cam is attached.
Figure 5C:
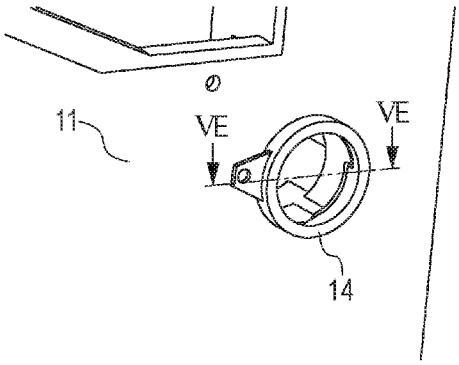
FIG. 5C is a perspective view of the drive-side side plate to which the cylinder cam is attached.
Figure 5E:
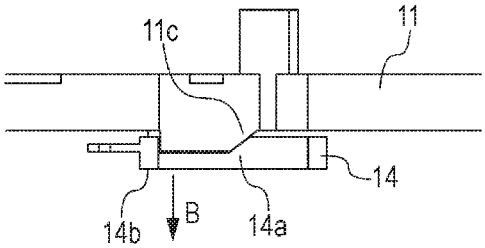
FIG. 5E is a sectional view of the drive-side side plate taken along line VE-VE in FIG. 5C.
Figure 5D:
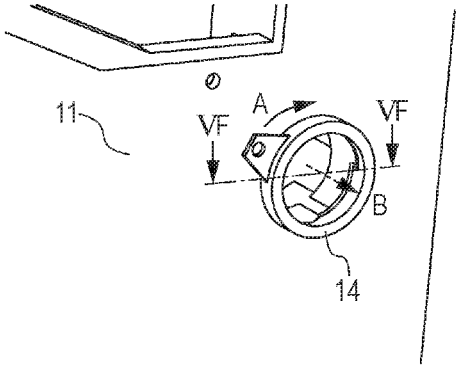
FIG. 5D is a perspective view of the drive-side side plate to which the cylinder cam is attached.
Figure 5F:
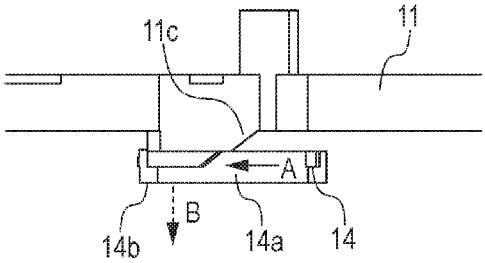
FIG. 5F is a sectional view of the drive-side side plate taken along line VF-VF in FIG. 5D.
Figure 6B:
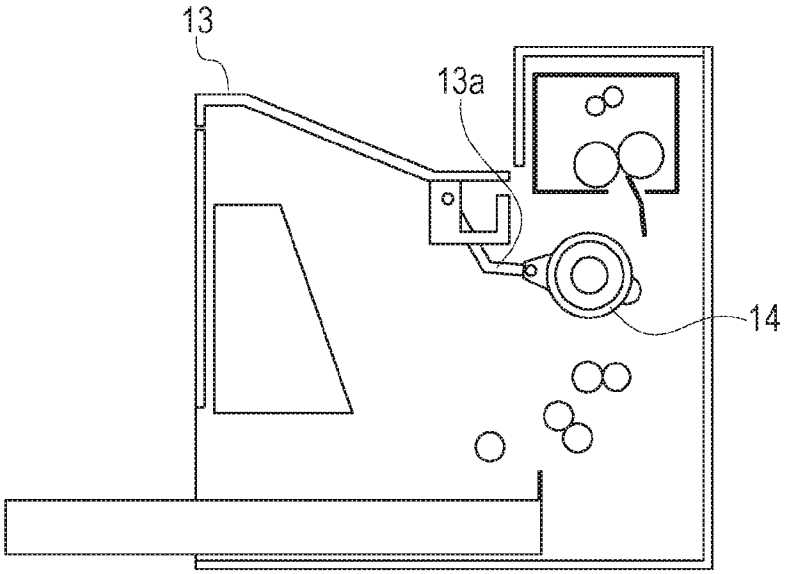
FIG. 6B is a schematic sectional view of the image-forming apparatus when the door is closed.
Figure 6A:
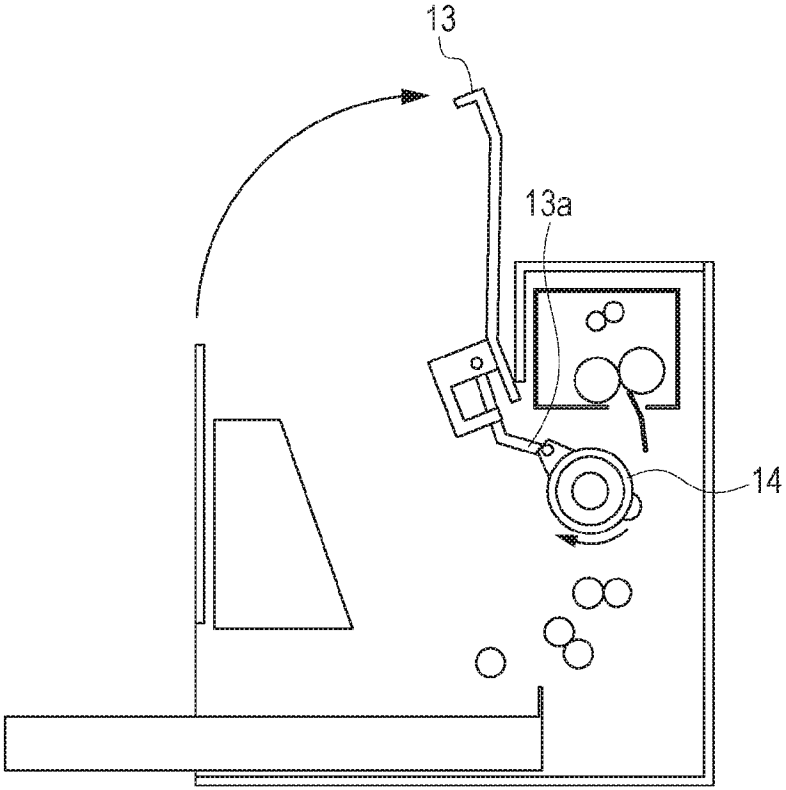
FIG. 6A is a schematic sectional view of the image-forming apparatus when a door is opened.
Figure 7:
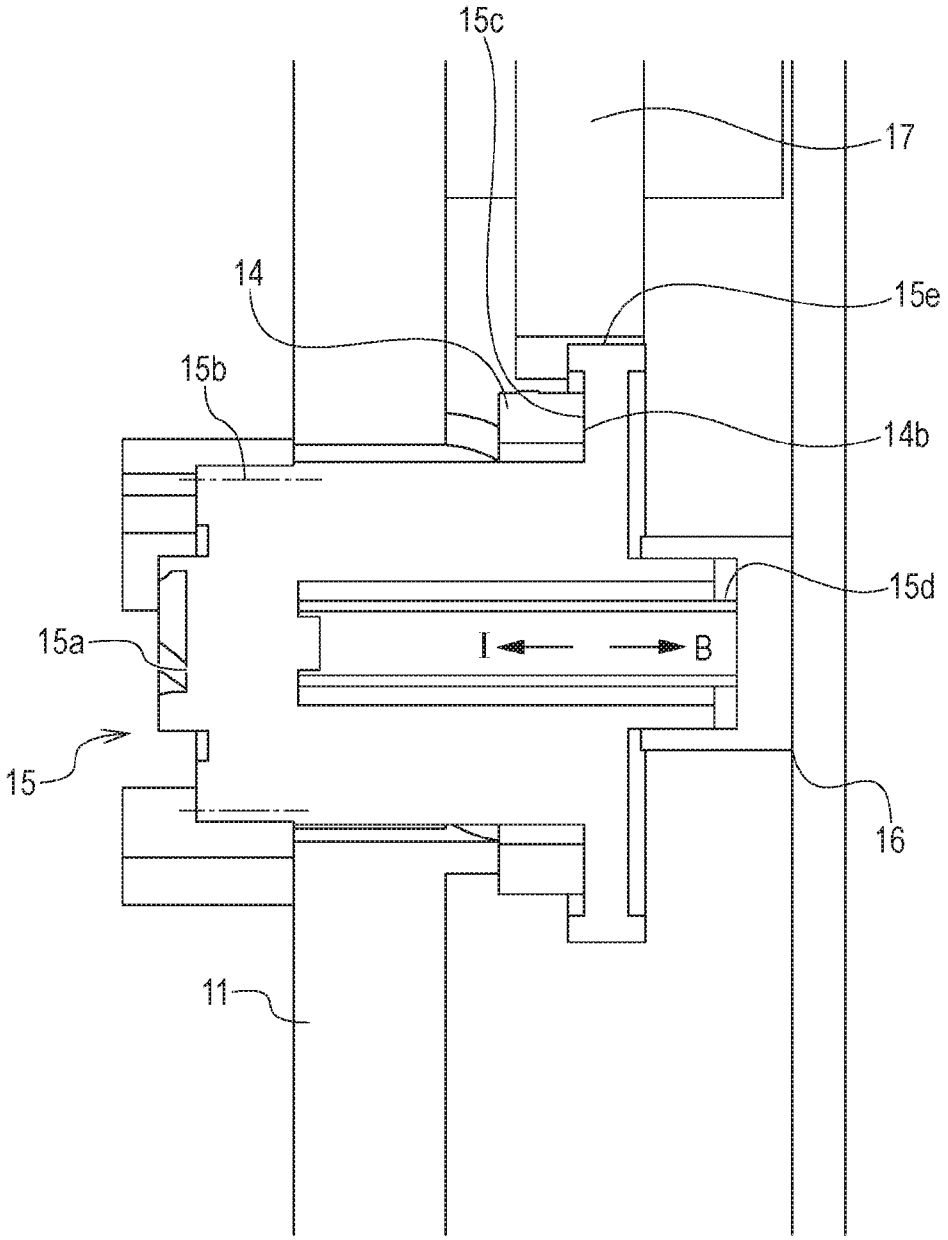
FIG. 7 is a schematic sectional view of a driving force transmitter.

Attachment and detachment of the cartridge C to and from the main body of the apparatus 1 will be described with reference to FIG. 4 to FIG. 7. FIG. 4 is a schematic perspective view of the main body of the apparatus 1 when a door 13 is opened. FIG. 5A is a perspective view of a cylinder cam 14. FIG. 5B is a perspective view of a drive-side side plate 11 near a location to which the cylinder cam 14 is attached. FIG. 5C is a perspective view of the drive-side side plate 11 to which the cylinder cam 14 is attached. FIG. 5D is a perspective view of the drive-side side plate 11 to which the cylinder cam 14 is attached. FIG. 5E is a sectional view of the drive-side side plate 11 taken along line VE-VE in FIG. 5C. FIG. 5F is a sectional view of the drive-side side plate 11 taken along line VF-VF in FIG. 5D. FIG. 6A is a schematic sectional view of the main body of the apparatus 1 when the door 13 is opened. FIG. 6B is a schematic sectional view of the main body of the apparatus 1 when the door 13 is closed. FIG. 7 is a sectional view of a driving force transmitter 15 on a plane passing through the rotational axis of the driving force transmitter 15.

The main body of the apparatus 1 includes the drive-side side plate 11, which has the drive trains on the left-hand side and the right-hand side, and a non-drive-side side plate 12. The door 13, which opens or closes when the cartridge is inserted or retracted, is disposed between the drive-side side plate 11 and the non-drive-side side plate 12. The drive-side side plate 11 and the non-drive-side side plate 12 each include guide rails 11*a* and 11*b* for inserting the cartridge C (guide rails of the non-drive-side side plate are not illustrated). When the cartridge C is installed, the cartridge C is inserted such that guided portions C4*a* and C4*b* (see FIG. 3B) of the cartridge on the drive side engage the guide rails 11*a* and 11*b* on the drive side, and a guided portion C4 (see FIG. 3A) engages one of the guide rails, not illustrated, of the non-drive-side side plate on the non-drive side. Thus, the cartridge C can be installed into an appropriate position.

As illustrated in FIGS. 6A and 6B, a door link 13*a* is attached at one end thereof to the door 13, and the other end of the door link 13*a* is connected to the cylinder cam 14. The cylinder cam 14 rotates in conjunction with an opening or closing operation of the door 13.

As illustrated in FIGS. 5C and 5E, the cylinder cam 14 is attached to the drive-side side plate 11 so as to be rotatable and movable in the direction of an arrow B. The direction of the arrow B is parallel to the axial direction of the photosensitive drum C21 of the cartridge C installed in the main body of the apparatus 1. As illustrated in FIG. 5A, the cylinder cam 14 includes slanted surfaces 14*a*. As illustrated in FIG. 5B, the drive-side side plate 11 includes slanted surfaces 11*c* facing the slanted surfaces 14*a* of the cylinder cam 14. The drive-side side plate 11 supports the cylinder cam 14 such that the cylinder cam 14 is rotatable about the center of the cylindrical shape thereof.

When the door 13 is opened or closed, the link 13*a* attached to the door 13 causes the cylinder cam 14 attached to the other end of the link 13*a* to rotate. When the door 13 is opened, the cylinder cam 14 rotates in the direction of an arrow illustrated in FIG. 6A. At this time, in FIG. 5D, the cylinder cam 14 rotates in the direction of an arrow A. As illustrated in FIG. 5E, since the slanted surfaces 14*a* of the cylinder cam 14 and the slanted surfaces 11*c* of the drive-side side plate are in contact with each other, as illustrated in FIG. 5F, the cylinder cam 14 moves in the direction of the arrow B along with the rotation of the cylinder cam 14.

As illustrated in FIG. 7, an end portion of the driving force transmitter 15 in the axial direction is fitted into a bearing 16 and supported so as to be rotatable and movable in the direction of the rotational axis denoted by an arrow I. The driving force transmitter 15 includes a cam contact surface 15C. The cam contact surface 15C of the driving force transmitter 15 is in contact with a contact surface 14*b* of the cylinder cam 14.

The driving force transmitter 15 is in contact with a spring 15*d* and urged in the direction of the arrow I (direction toward the cartridge). The urging force causes the cam contact surface 15C of the driving force transmitter 15 and the contact surface 14*b* of the cylinder cam to be in contact with each other. The cylinder cam 14 is moved in the direction of the arrow B along with the opening operation of the door 13, as described above. The driving force transmitter 15 in contact with the cylinder cam 14 is also moved in the direction of the arrow B and pressed toward the outside of the main body. This position is referred to as a retracted position of the driving force transmitter 15. The direction of the arrow B is opposite to the direction of the arrow I. A series of movements when the door 13 is opened cause the driving force transmitter 15 to move in the direction of the arrow B and to be retracted from a trajectory along which the cartridge is attached or detached. This enables the driving force transmitter 15 to be inhibited from interfering with the cartridge C during attachment or detachment of the cartridge C.

Driving Force Transmitter

The structure of the driving force transmitter 15 will now be described. As illustrated in FIG. 7, the driving force transmitter 15 includes a first gear portion 15*e* engaging a front gear 17 to which a driving force is transmitted from a motor, not illustrated, and rotates about a predetermined rotational axis when the first gear portion 15*e* receives the driving force from the motor. The rotational axis of the driving force transmitter 15 coincides with the rotational axis of the photosensitive drum C21 in a state where the cartridge C is installed in the main body of the apparatus 1. The driving force transmitter 15 also includes a coupling recess 15*a* (first engaging portion) and a second gear portion 15*b* (second engaging portion) for transmitting a driving force to the cartridge C. The coupling recess 15*a* is a trigonal prismatic recess that extends in the direction of the rotational axis and that is twisted. Three inner wall surfaces thereof that are twisted correspond to driving-force transmission surfaces. The second gear portion 15*b* is located farther than the coupling recess 15*a* from the rotational axis of the driving force transmitter 15 in a direction of the radius extending from the center that is on the rotational axis of the driving force transmitter 15.

Figure 8A:
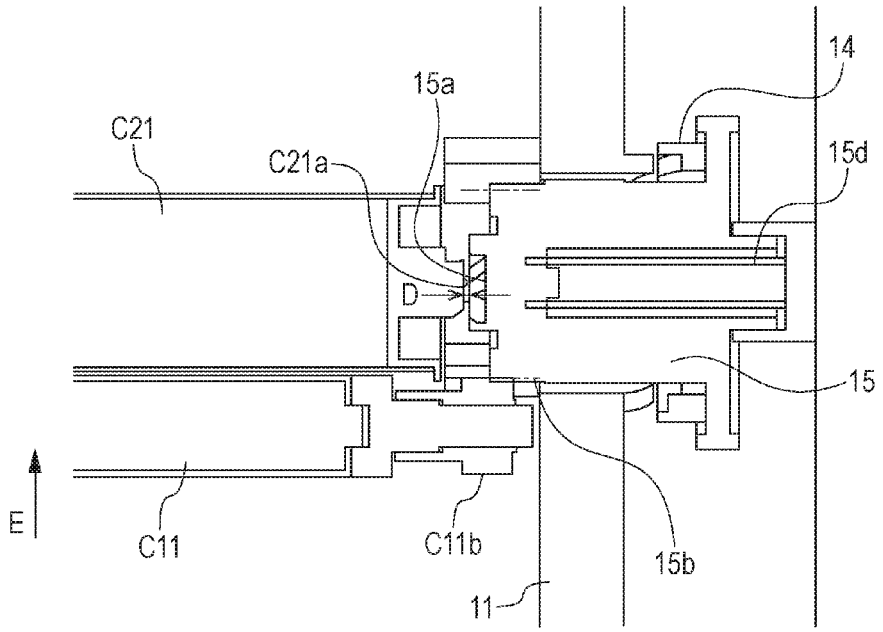
FIG. 8A is a sectional view of the image-forming apparatus near the driving force transmitter with the cartridge installed.
Figure 8B:
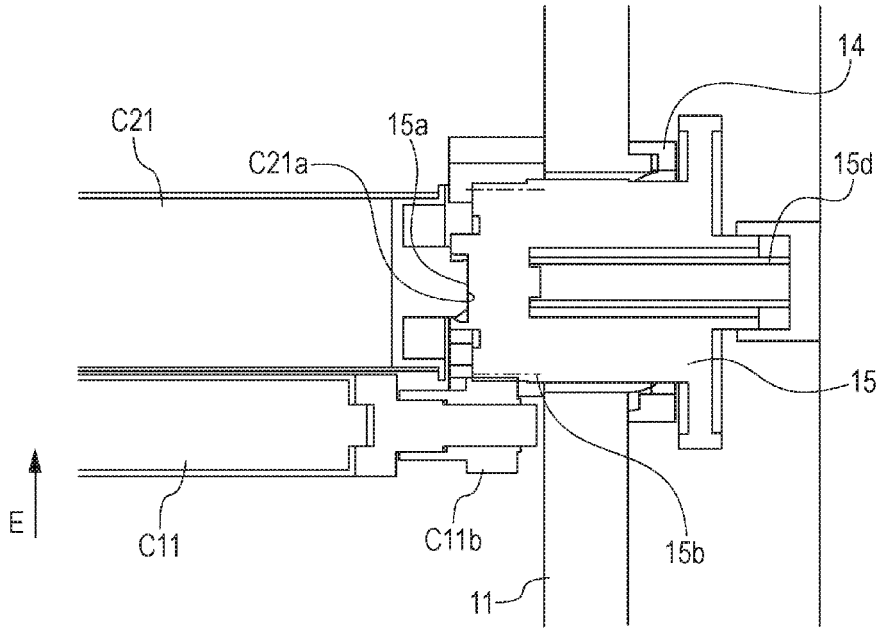
FIG. 8B is a sectional view of the image-forming apparatus near the driving force transmitter with the cartridge installed.

FIG. 8A is a sectional view of the main body of the apparatus 1 near the driving force transmitter 15 with the cartridge C installed in the main body of the apparatus 1 when the driving force transmitter 15 is located at the retracted position. The section is on a plane passing through the rotational axes of the driving force transmitter 15 and the developing roller C11. The direction in which the cartridge C is inserted coincides with the direction of an arrow E. FIG. 8B is a sectional view of the main body of the apparatus 1 near the driving force transmitter 15 with the cartridge C installed in the main body of the apparatus 1 when the driving force transmitter 15 is located at a protruded position. The section is on a plane passing through the rotational axes of the driving force transmitter 15 and the developing roller C11. When the door 13 is closed after the cartridge C is inserted, the link 13*a* causes the cylinder cam 14 to rotate in the direction opposite to the direction in which the cylinder cam 14 rotates when the door 13 is opened, and the cylinder cam 14 moves to the cartridge side along the slanted surfaces 11*c* of the drive-side side plate together with the driving force transmitter 15. When the driving force transmitter 15 is rotated by the motor after the door 13 is closed, the coupling recess 15*a* engages the coupling protrusion C21*a* of the cartridge C, and the driving force transmitter 15 moves to the protruded position in FIG. 8B.

In a state where the cartridge C is inserted in the main body of the apparatus 1 and the door 13 is opened, the driving force transmitter 15 is located at the retracted position. As illustrated in FIG. 8A, the coupling recess 15*a* and the coupling protrusion C21*a* of the cartridge C face each other at a predetermined interval D. The second gear portion 15*b* of the driving force transmitter 15 engages the gear C11*b* disposed coaxially with the developing roller C11 of the cartridge C.

Insertion of Cartridge

Figure 9:
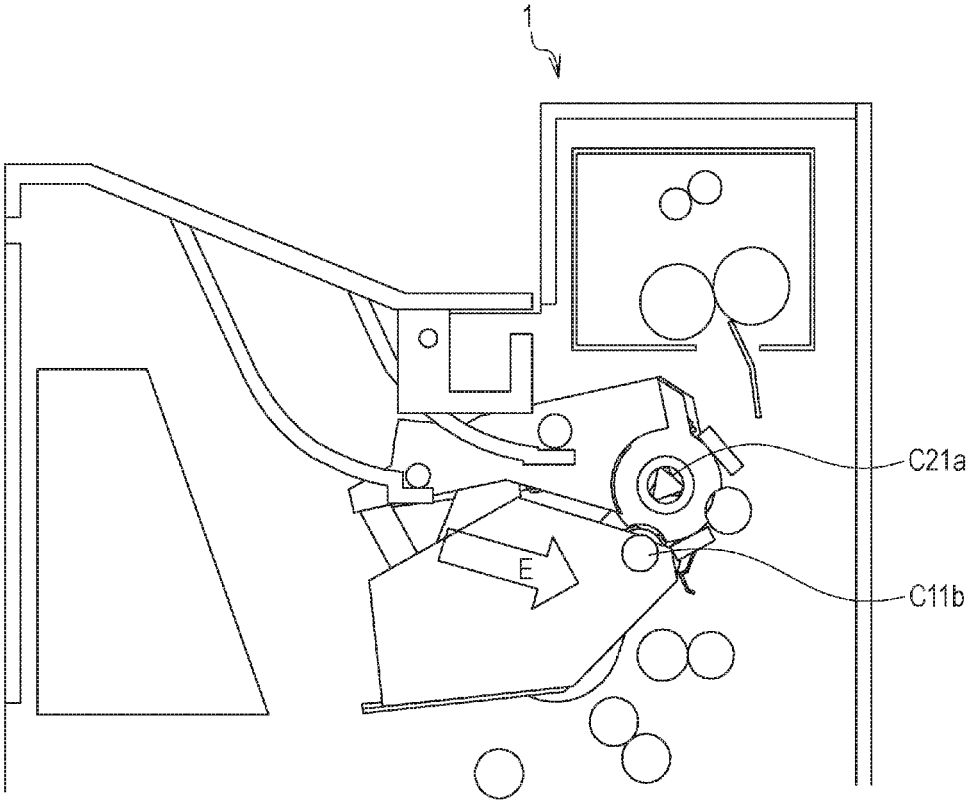
FIG. 9 is a sectional view of part of a main body of the apparatus in which the cartridge is installed.

FIG. 9 is a sectional view of part of the main body of the apparatus 1 in which the cartridge C is installed. The section is on a plane perpendicular to the axis of the photosensitive drum C21. As illustrated in FIG. 9, the gear C11*b* is located upstream of the coupling protrusion C21*a* in the direction (direction of the arrow E) in which the cartridge C is inserted. That is, the second gear portion 15*b* of the driving force transmitter 15 is located downstream of the gear C11*b* in the direction (direction of the arrow E) in which the cartridge C is inserted in a state where the cartridge C is installed in the main body of the apparatus 1. For this reason, in both cases where the driving force transmitter 15 is located at the retracted position and the protruded position, the gear C11*b* is located so as to be in contact with the second gear portion 15*b* of the driving force transmitter 15 when the cartridge C is inserted into the main body of the apparatus 1. Accordingly, while the cartridge C is inserted into the main body of the apparatus 1, the gear C11*b* and the second gear portion 15*b* relatively displace in the direction of the insertion (direction of the arrow E). The direction (direction of the arrow E) in which the cartridge C is inserted is perpendicular to the rotational axis of the driving force transmitter 15.

For this reason, in the case where the phases of the gear C11*b* and the second gear portion 15*b* are the same during the insertion of the cartridge C, the gear C11*b* and the second gear portion 15*b* engage each other as it is, and the cartridge C is contained at a predetermined position.

Figure 10A:
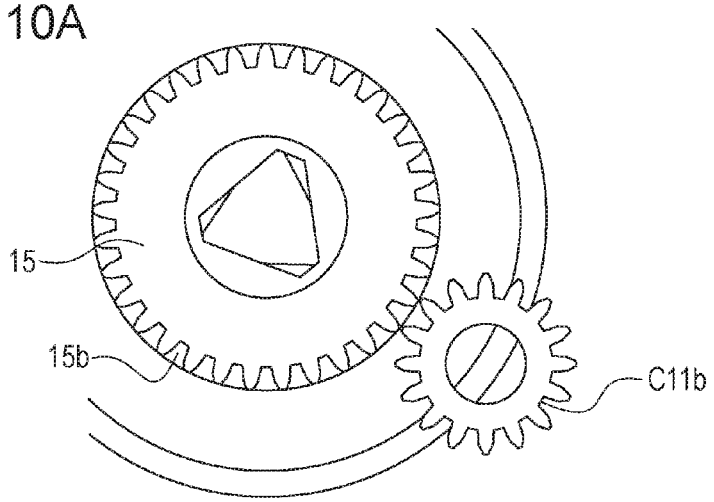
FIG. 10A illustrates a process in which a gear is engaged when the cartridge is inserted.
Figure 10B:
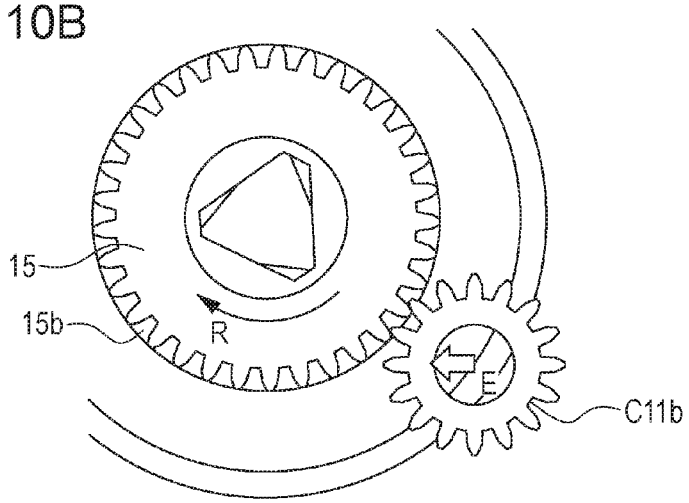
FIG. 10B illustrates the process in which the gear is engaged when the cartridge is inserted.
Figure 10C:
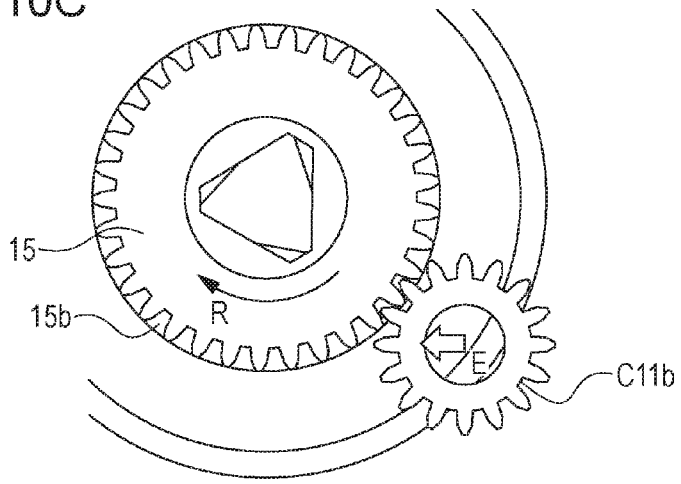
FIG. 10C illustrates the process in which the gear is engaged when the cartridge is inserted.

The following description includes the case where the phases of the gear C11*b* and the second gear portion 15*b* are different from each other during the insertion of the cartridge C. FIGS. 10A to 10C illustrate a process in which the gear C11*b* engages the second gear portion 15*b* when the cartridge C is inserted. In the case where the phases of the gear C11*b* and the second gear portion 15*b* are different from each other, as illustrated in FIG. 10A, the outermost portion of a tooth of the gear C11*b* and the outermost portion of a tooth of the second gear portion 15*b* first come into contact with each other. While the cartridge C is further inserted into the main body of the apparatus 1, the gear C11*b* moves in the direction of the arrow E while the second gear portion 15*b* rotates in the direction of an arrow R. Finally, as illustrated in FIG. 10C, the second gear portion 15*b* rotates until the second gear portion 15*b* engages the gear C11*b*, and the insertion of the cartridge C into the main body of the apparatus 1 is completed.

According to the first embodiment, the second gear portion 15*b* thus rotates in the case where the outermost portion of the tooth of the gear C11*b* and the outermost portion of the tooth of the second gear portion 15*b* come into contact with each other during the insertion of the cartridge C. That is, a driving torque required to rotate the driving force transmitter 15 from a state of rest is less than a driving torque required to rotate the gear C11*b* from a state of rest.

The driving torque required to rotate the driving force transmitter 15 is a torque required to rotate not only the driving force transmitter 15 but also the front gear 17 that transmits a driving force to the driving force transmitter 15 and the motor, not illustrated, from a state of rest. The driving torque required to rotate the driving force transmitter 15 from a state of rest can also be referred to as a torque required to rotate the second gear portion 15*b* from a state of rest. The driving torque required to rotate the gear C11*b* is a torque required to rotate not only the gear C11*b* but also the developing roller C11 to which the gear C11*b* transmits a driving force and the toner conveying member C17 from a state of rest.

Since the driving torque satisfies such a relationship, the gear C11*b* of the cartridge C, and the developing roller C11 and the toner conveying member C17 to which the gear C11*b* transmits a driving force do not move. For this reason, a defective image due to toner leaking and adhering to the photosensitive drum C21 can be inhibited from occurring.

Second Embodiment

According to the first embodiment, the second gear portion 15*b* and the gear C11*b* engage each other during the insertion of the cartridge C. According to a second embodiment, the second gear portion 15*b* and the gear C11*b* engage each other earlier than the others when the driving force transmitter 15 moves in the axial direction. This structure will be described. Components like to those in the first embodiment are designated by like symbols, and a description thereof is omitted.

Figure 11A:
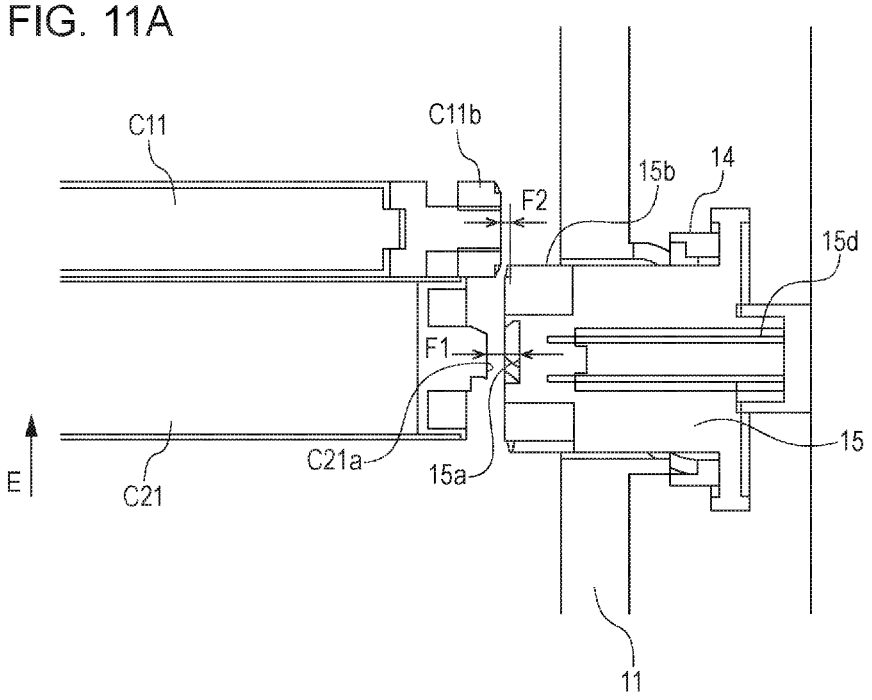
FIG. 11A is a sectional view of the image-forming apparatus near the driving force transmitter with the cartridge installed.
Figure 11B:
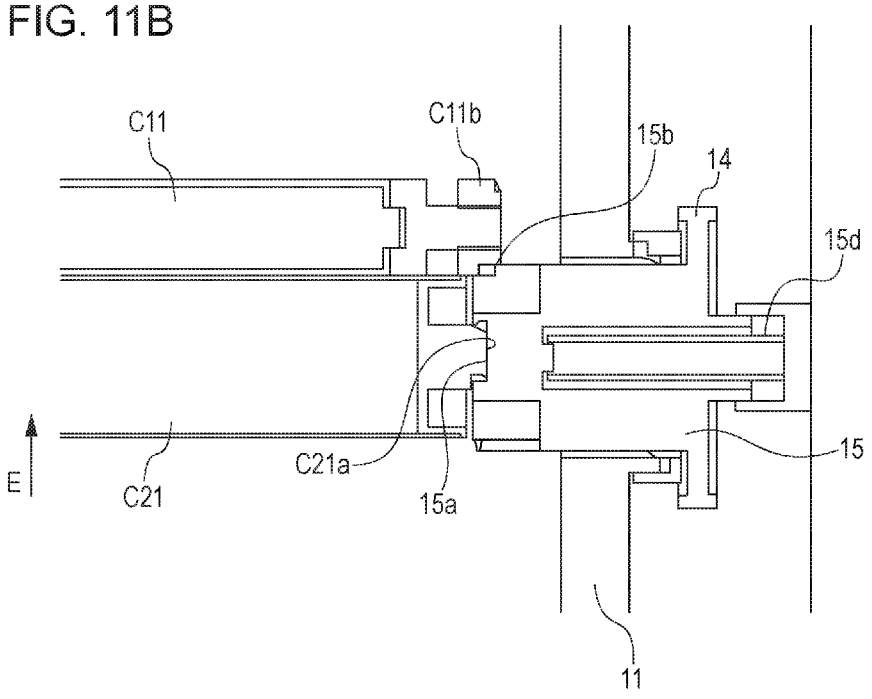
FIG. 11B is a sectional view of the image-forming apparatus near the driving force transmitter with the cartridge installed.

FIG. 11A is a sectional view of the main body of the apparatus 1 near the driving force transmitter 15 with the cartridge C installed in the main body of the apparatus 1 when the driving force transmitter 15 is located at the retracted position. The section is on a plane passing through the rotational axes of the driving force transmitter 15 and the developing roller C11. The direction in which the cartridge C is inserted coincides with the direction of the arrow E. FIG. 11B is a sectional view of the main body of the apparatus 1 near the driving force transmitter 15 with the cartridge C installed in the main body of the apparatus 1 when the driving force transmitter 15 is located at the protruded position. The section is on a plane passing through the rotational axes of the driving force transmitter 15 and the developing roller C11.

In a state where the door 13 is opened, as illustrated in FIG. 11A, the driving force transmitter 15 is retracted, and driving-force-transmitting portions are not in contact with each other. A clearance (space) between the coupling recess 15*a* and the coupling protrusion C21*a* in the direction of the rotational axis of the driving force transmitter 15 is denoted by F1. A clearance between the second gear portion 15*b* and the gear C11*b* in the direction of the rotational axis of the driving force transmitter 15 is denoted by F2. The clearance F1 is larger than the clearance F2.

When the door 13 is closed, as illustrated in FIG. 11B, the driving force transmitter 15 moves in the direction of the rotational axis and approaches the cartridge C. Because of the relationship of magnitude between the clearance F1 and the clearance F2, the second gear portion 15*b* and the gear C11*b* come into contact with each other earlier than contact between the coupling recess 15*a* and the coupling protrusion C21*a*, along with the movement of the driving force transmitter 15 in the direction of the rotational axis. That is, the second gear portion 15*b* and the gear C11*b* come into contact with each other in a manner in which the driving force transmitter 15 relatively displaces in the direction of the rotational axis. At this time, in the case where the phases of the gear C11*b* and the second gear portion 15*b* are the same (phases that enable the gear C11*b* and the second gear portion 15*b* to engage each other), the teeth of the second gear portion 15*b* enter spaces between the teeth of the gear C11*b*, and the gear is engaged. Subsequently, the coupling recess 15*a* and the coupling protrusion C21*a* engage each other.

The following description includes the case where the phases of the gear C11*b* and the second gear portion 15*b* are different from each other when the driving force transmitter 15 moves in the direction of the rotational axis.

Figure 12A:
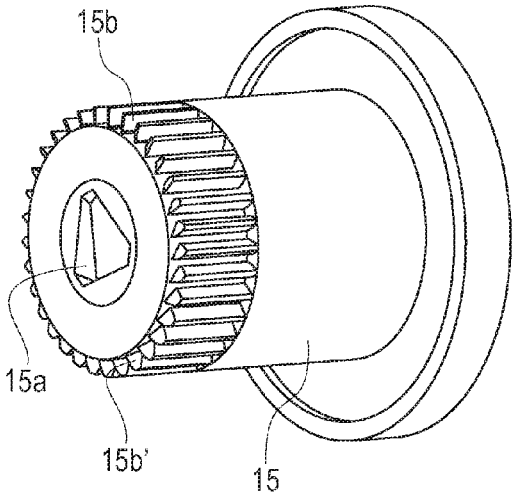
FIG. 12A is a perspective view of the driving force transmitter.
Figure 12B:
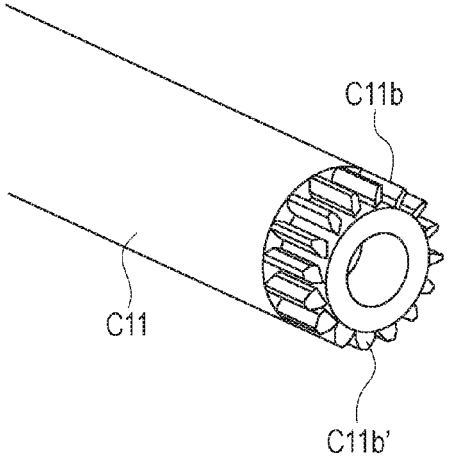
FIG. 12B is a perspective view of a developing roller.

FIG. 12A is a perspective view of the driving force transmitter 15. FIG. 12B is a perspective view of the developing roller C11. FIGS. 13A to 13I illustrate the relationship between the second gear portion 15*b* and the gear C11*b*. FIGS. 13A, 13D, and 13G are diagrams viewed from the direction of the rotational axis of the driving force transmitter 15. FIGS. 13B, 13E, and 13H are perspective diagrams. FIGS. 13C, 13F, and 13I are diagrams viewed from the direction perpendicular to the rotational axis of the driving force transmitter 15.

As illustrated in FIG. 12A, a guiding slanted surface 15*b*' is formed on each tooth at the gear end portion of the second gear portion 15*b* facing the cartridge C. As illustrated in FIG. 12B, a guiding slanted surface C11*b*' is formed on each tooth at the gear end portion of the gear C11*b*.

FIGS. 13A, 13B, and 13C illustrate a state before the second gear portion 15*b* and the gear C11*b* come into contact with each other. When the driving force transmitter 15 moves in the direction of the rotational axis from this state, as illustrated in FIGS. 13D, 13E, and 13F, the driving force transmitter 15 relatively displaces in the direction of the rotational axis, and the second gear portion 15*b* and the gear C11*b* come into contact with each other. At this time, the contact between the slanted surface 15*b*' of the second gear portion 15*b* and the slanted surface C11*b*' of the gear C11*b* causes the second gear portion 15*b* and the gear C11*b* to relatively rotate. Here, the driving torque required to rotate the driving force transmitter 15 from a state of rest is less than the driving torque required to rotate the gear C11*b* from a state of rest. For this reason, the driving force transmitter 15 rotates until the phase thereof becomes a phase that enables the teeth of the second gear portion 15*b* to enter spaces between the teeth of the gear C11*b*, and the gear C11*b* and the second gear portion 15*b* engage each other. Subsequently, as illustrated in FIGS. 13G, 13H, and 13I, the driving force transmitter 15 further moves in the direction of the rotational axis, and the coupling recess 15*a* and the coupling protrusion C21*a* engage each other.

Also, according to the second embodiment, the driving torque required to rotate the driving force transmitter 15 from a state of rest is less than the driving torque required to rotate the gear C11*b* from a state of rest. For this reason, the gear C11*b* of the cartridge C, the developing roller C11 and the toner conveying member C17 to which the gear C11*b* transmits a driving force do not move. Consequently, a defective image due to toner leaking and adhering to the photosensitive drum C21 can be inhibited from occurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-129040 filed Jun. 29, 2016, which is hereby incorporated by reference herein in its entirety.

What is claimed is:

1. An image-forming apparatus, comprising:

a main body of the apparatus in which a cartridge is mountable, the cartridge including a first driven body, a second driven body, a first engaged portion to be engaged for receiving a driving force that causes the first driven body to be driven, and a second engaged portion to be engaged for receiving a driving force that causes the second driven body to be driven; and a driving force transmitter rotatable about a rotational axis thereof, the driving force transmitter including a first engaging portion engaging the first engaged portion to rotate the first engaged portion and a second engaging portion engaging the second engaged portion to rotate the second engaged portion, wherein a torque required to rotate the second engaged portion is larger than a torque required to rotate the second engaging portion in a state where the first engaging portion does not engage the first engaged portion.

2. The image-forming apparatus according to claim 1, wherein the second engaging portion is configured to engage the second engaged portion in a manner in which the second engaged portion and the second engaging portion relatively displace in a direction perpendicular to the rotational axis and come into contact with each other and the second engaging portion subsequently rotates.

3. The image-forming apparatus according to claim 2, configured such that, while the cartridge is being mounted into the main body of the apparatus, the second engaged portion and the second engaging portion come into contact with each other before the first engaging portion engages the first engaged portion.

4. The image-forming apparatus according to claim 1, wherein the second engaging portion is configured to engage the second engaged portion in a manner in which the second engaged portion and the second engaging portion relatively displace in a direction of the rotational axis and come into contact with each other and the second engaging portion subsequently rotates.

5. The image-forming apparatus according to claim 1, wherein the first driven body is a photosensitive drum, and the second driven body is a developing roller for causing a toner to adhere to the photosensitive drum.

6. The image forming apparatus according to claim 1, wherein a relative movement between the cartridge and the driving force transmitter, in a direction mutually approaching and paralleled to a rotational axis direction of the first driven body, allows the first engaging portion and the second engaging portion to engage with the first engaged portion and the second engaged portion, respectively.

7. The image forming apparatus according to claim 6, wherein after the cartridge is mounted in the main body of the apparatus in a direction crossing the rotational axis direction of the first driven body, the driving force transmitter moves toward the cartridge in a direction along the rotational axis direction of the first driven body.

8. The image forming apparatus according to claim 7, wherein the main body of the apparatus includes an opening through which the cartridge is mounted in the main body of the apparatus and a door configured to move so as to open and close the opening, and wherein the driving force transmitter moves in conjunction with the movement of the door.

9. The image forming apparatus according to claim 6, wherein the second engaging portion is a driving gear which has tooth formed on a circumferential surface of the driving force transmitter centered on the rotational axis of the driving force transmitter, and the first engaging portion is a driving coupling centered on the rotational axis of the driving force transmitter and provided on an end surface of the driving force transmitter in a direction of the rotational axis of the driving force transmitter, the driving coupling being provided inside a tip circle of the driving gear when viewed in the direction paralleled to the rotational axis of the driving force transmitter.

10. The image forming apparatus according to claim 9, wherein the driving coupling is a concave provided on the end surface of the driving force transmitter.

11. The image forming apparatus according to claim 10, wherein the first engaged portion is a driven coupling protruding toward the driving coupling and centered on a first rotational axis of the first driven body, and the second engaged portion is a driven gear centered on a second rotational axis of the second driven body, the first rotational axis and the second rotational axis being not coaxially arranged, and wherein in the rotational axis direction of the first driven body, an end of the driven gear is arranged closer to the driving force transmitter than an end of the driven coupling.

12. The image forming apparatus according to claim 6, wherein in the rotational axis direction of the first driven body, an end of the second engaged portion is arranged closer to the driving force transmitter than an end of the first engaged portion.

13. The image forming apparatus according to claim 12, wherein the first engaged portion is a driven coupling centered on a first rotational axis of the first driven body, and the second engaged portion is a driven gear centered on a second rotational axis of the second driven body, the first rotational axis and the second rotational axis being not coaxially arranged.

14. A cartridge mountable in a main body of an image-forming apparatus, the main body including a driving force transmitter rotatable about a rotational axis, the driving force transmitter including a first engaging portion and a second engaging portion, comprising:

a first driven body;

a second driven body;

a first engaged portion configured to be engaged with the first engaging portion for receiving a driving force that causes the first driven body to be driven; and a second engaged portion configured to be engaged with the second engaging portion for receiving a driving force that causes the second driven body to be driven, wherein a torque required to rotate the second engaged portion is larger than a torque required to rotate the second engaging portion in a state where the first engaging portion does not engage the first engaged portion.

15. The cartridge according to claim 14, configured such that the second engaging portion engages the second engaged portion in a manner in which the second engaged portion and the second engaging portion relatively displace in a direction perpendicular to the rotational axis and come into contact with each other and the second engaging portion subsequently rotates.

16. The cartridge according to claim 15, configured such that, while the cartridge is being mounted into the main body of the apparatus, the second engaged portion and the second engaging portion come into contact with each other before the first engaging portion engages the first engaged portion.

17. The cartridge according to claim 14, configured such that the second engaging portion engages the second engaged portion in a manner in which the second engaged portion and the second engaging portion relatively displace in a direction of the rotational axis and come into contact with each other and the second engaging portion subsequently rotates.

18. The cartridge according to claim 14, wherein the first driven body is a photosensitive drum, and the second driven body is a developing roller for causing a toner to adhere to the photosensitive drum.

* * * * *